US006347985B1

(12) United States Patent
Loveless

(10) Patent No.: US 6,347,985 B1
(45) Date of Patent: Feb. 19, 2002

(54) LOW PROFILE VACUUM DRIVEN SANDER

(76) Inventor: Michael Loveless, 600 S. Nick La., Price, UT (US) 84501

( * ) Notice: Subject to any disclaimer, the term of this patent is extended or adjusted under 35 U.S.C. 154(b) by 0 days.

(21) Appl. No.: 09/598,282

(22) Filed: Jun. 22, 2000

(51) Int. Cl.[7] ..... B24B 7/18; B24B 23/04
(52) U.S. Cl. ..... 451/354; 451/456
(58) Field of Search ..... 451/357, 354, 451/456, 344; 384/624

(56) References Cited

U.S. PATENT DOCUMENTS

| | | | | |
|---|---|---|---|---|
| 1,800,341 | A | | 4/1931 | Davies |
| 3,468,076 | A | | 9/1969 | Jones |
| 3,722,147 | A | | 3/1973 | Brenner |
| 3,785,092 | A | | 1/1974 | Hutchins |
| 4,052,824 | A | | 10/1977 | Hutchins |
| 4,062,152 | A | | 12/1977 | Mehrer |
| 4,184,291 | A | | 1/1980 | Marton |
| 4,399,638 | A | | 8/1983 | Rodowsky, Jr. |
| 4,616,449 | A | | 10/1986 | Marton |
| 4,697,398 | A | | 10/1987 | Romine |
| 4,782,632 | A | | 11/1988 | Matechuk |
| 4,905,420 | A | | 3/1990 | Flachenecker |
| 5,007,206 | A | | 4/1991 | Paterson |
| 5,018,314 | A | | 5/1991 | Fushiya |
| D326,398 | S | | 5/1992 | Fushiya et al. |
| 5,144,774 | A | | 9/1992 | Conboy |
| 5,185,544 | A | * | 2/1993 | Takada ..... 384/476 |
| 5,193,313 | A | | 3/1993 | Sanchez et al. |
| 5,228,244 | A | | 7/1993 | Chu |
| 5,283,988 | A | | 2/1994 | Brown |
| D351,976 | S | | 11/1994 | Morey et al. |
| D353,313 | S | | 12/1994 | Stiles |
| 5,384,984 | A | | 1/1995 | Smith |
| D375,885 | S | | 11/1996 | Taylor |
| 5,582,541 | A | | 12/1996 | Hutchins |
| 5,595,530 | A | | 1/1997 | Heidelberger |
| 5,605,500 | A | | 2/1997 | Matechuk |
| 5,624,305 | A | | 4/1997 | Brown |
| 5,637,034 | A | | 6/1997 | Everts et al. |
| D392,861 | S | | 3/1998 | Gildersleeve |

* cited by examiner

*Primary Examiner*—Robert A. Rose
(74) *Attorney, Agent, or Firm*—M. Reid Russell

(57) ABSTRACT

A low profile vacuum driven sander as is appropriate for drywall sanding, with a vacuum flow pulled therethrough to drive a turbine whose turning through an eccentric provides an oscillating movement to a sanding pad that releasably mounts a section of sanding material thereto, and with that vacuum air flow also removing sanded particles and dust off from the sanded surface and transports it through the sander and a connected pipe or hose into a catchment container. The sander housing includes a pair of spaced inlet ports that are formed to provide a balance air flow into a turbine chamber that contains a turbine that is journaled axially to bearings of a bearing assembly maintained in a bearing assembly cavity of a center stanchion, with the bearing assembly cavity separated from the vacuum air flow and is ported to without the sander housing for providing, when the sander is operating, a fresh air flow into the bearing assembly cavity, prohibiting dust as is entrained in the vacuum air flow from entering the cavity as could interfere with bearing functioning and result in a loss in sander efficiency and malfunction. The turbine is preferably formed from upper and lower sections that are of different heights for facilitating assembly of the bearings in the bearing assembly cavity to, in turn, allow the sander housing to be formed having a low profile, and includes a coupling assembly of the sander body to a vacuum tube that can be freely adjusted and locked in place at a desired angle to a surface to be sanded.

40 Claims, 7 Drawing Sheets

LOW PROFILE VACUUM DRIVEN SANDER

BACKGROUND OF THE INVENTION

1. Field of the Invention

This invention pertains to sanding devices, and in particular to a light weight pole sander for use in sanding dry wall that is attached to a vacuum hose to be vacuum driven and to remove sanding dust off of a wall surface and pull that dust into a vacuum canister.

2. Prior Art

The present invention contemplates a new and improved vacuum driven sander that is appropriate for mounting onto a hollow tube or pole to be manually moved over a sheet rock wall to function as a dry wall sander, providing an oscillating sanding section that mounts a sheet of sanding material. The sanding section of the sander is operated by a vacuum driven turbine to smooth a dry wall surface, creating dust that is pulled through the turning turbine blades and into the hollow tube that a vacuum hose is connected to, to vent into a vacuum canister.

Heretofore, a number of sanding tools incorporating vacuum devices for removal of sanded particles and for transporting them through a connected vacuum hose to a collection vessel have been employed. For example a number of U.S. utility patents to Mehrer U.S. Pat. No. 4,062,152; to Marton U.S. Pat. No. 4,184,291; to Romine U.S. Pat. No. 4,697,389; to Paterson U.S. Pat. No. 5,007,206; to Sanchez, et al. U.S. Pat. No. 5,193,313; to Brown U.S. Pat. No. 5,283,988; to Matchuk U.S. Pat. No. 5,605,600; and to Brown U.S. Pat. No. 5,624,305, all show examples of manual sanding devices whereto is connected a vacuum hose for drawing dust off from a surface being sanded. Similarly, a number of electric motor driven devices that connect through a hose to a vacuum or suction device have been developed and examples of such are shown in U.S. Patents to Davies U.S. Pat. No. 1,800,341; to Jones U.S. Pat. No. 3,468,076; to Hutchins U.S. Pat. No. 3,785,092; to Hutchins U.S. Pat. No. 4,052,420; to Matechuk U.S. Pat. No. 4,782,632; to Flacheneck, et al. U.S. Pat. No. 4,905,420; to Fushiya et al. U.S. Pat. No. 5,018,314; to Chu, et al. U.S. Pat. No. 5,228,224; to Smith U.S. Pat. No. 5,384,984; to Hutchins U.S. Pat. No. 5,582,541; to Heidelberger U.S. Pat. No. 5,595,530; to Everts, et al. U.S. Pat. No. 5,637,034; and in Design Patents to Taylor U.S. Pat. No. Des. 375,885; to Gildersleeve et al. U.S. Pat. No. Des. 392,861; to Fushiya et al. U.S. Pat. No. Des. 326,398; to Morey et al. U.S. Pat. No. Des 351,976; and to Stiles U.S. Pat. No. Des. 353,313. None of which sanding devices, however, provide a sanding device that includes a vacuum driven oscillating sanding disk that, additionally, provides for removal of sanded particles from the work surface through an attached vacuum hose that is like that of the invention. Similar to the invention, U. S. Patents to Brenner U.S. Pat. No. 3,722,147; to Rodowsky, Jr. et al. U.S. Pat. No. 4,399,638; to Brenner U.S. Pat. No. 3,722,147; and to Marton U.S. Pat. No. 4,616,449, shown sanding devices where an oscillating plate mounting a sheet of sand paper is air driven by a vacuum flow and also provides for removal of sanding dust off from a work surface and the moving of that collected dust through a vacuum hose into a collection container. With the patent to Rodowsky, Jr. et al., U.S. Pat. No. 4,399,638 believed to be the closest to the invention. However, while, like the invention, the '638 patent provides a turbine blade that is turned by a vacuum air flow passed over the turbine blades to operate an oscillating plate whereto a section of sanding material is attached and will pull sanding dust therethrough, the turbine bearings of the '638 patent are exposed to that vacuum air flow with entrained sanding dust particles tending to collect in the turbine bearings, greatly limiting bearing life and, accordingly, the life of the device. Whereas, the invention is arranged to provide the presence of a positive or greater than vacuum pressure across its turbine bearing assembly, prohibiting the dust contaminated vacuum air flow from traveling into which bearing assembly, greatly lengthening the life of the bearings, and further allows for passing lubricants therethrough to lubricate the bearing assembly bearings, greatly improving upon earlier vacuum sanding devices, such as the '638 patent.

Additionally, as improvements over the prior art, the invention includes a balanced split-air intake that provides a balanced driving force onto the turbine blades by drawing essentially equal air flows from both sides of the sander that also improves upon the entrainment of dust and contaminants in the air flows as are passed through the sander. Also, the turbine itself is improvement in that it incorporates a split design where the top and bottom turbine sections are not symmetrical, with the lower turbine section having the greater height to allow the bearings and bearing supports to be conveniently fitted inside the turbine mounting in the sander housing providing a turbine housing profile that is shorter than former sanders turbines and has a lower center of gravity as compared to earlier sanders. Further, the invention provides an improved pole coupling assembly whereby, the pole angle to the sander top surface can be conveniently changed and that angle can be maintained while the sander is moved up and down or along a wall surface.

SUMMARY OF THE INVENTION

It is a principal object of the present invention to provide a vacuum air driven turbine operated sander for attachment to a conventional vacuum line wherethrough an air flow is pulled, with the air turning the turbine that is, in turn, connected to turn an eccentric that is fitted into a bearing mounted in a sanding plate to oscillate that plate, thereby moving an attached sheet of sanding material in an orbital path over a surface to be sanded.

Another object of the present invention is to provide a vacuum driven sander that includes turbine blades and turbine bearing assembly for turning in a housing wherein a passage is provided for passing a flow of clean air at ambient pressure into the bearing assembly, providing cooling thereto, and discouraging the vacuum flow wherein sanding dust is entrained from passing to the bearings of the bearing assembly and providing for passing a lubricant therethrough into the bearing assembly, greatly extending the bearing life and the life of the device.

Another object of the present invention is to provide a vacuum driven sander having a low profile provided by an incorporation of a turbine, as the device motive power source, that is formed from two non-symmetrical halves and includes, as a bearing assembly, a pair of bearing and bearing supports, that are to be fitted into a stanchion formed within the sander housing to contain turbine section, with the turbine top and bottom sections to be fitted together to close off which turbine section in the sander housing.

Still another object of the present invention is to provide a vacuum sander having a balanced split-air intake where air is drawn from opposite sides of the housing through the turbine, efficiently picking up and entraining dust particles in the flows as are generated by oscillating movement of the sanding pad that is provided by turbine rotation.

Still another object of the present invention is to provide a vacuum sander that incorporates a hollow tube connected to the sander body to be conveniently adjusted at its mounting to the body top surface to change the sander pad surface angle to the wall being sanded, and provides for connection of a vacuum tube as a pole to the hollow tube end opposite to the sander body.

Still another object of the present invention is to provide a vacuum driven sander that is light in weight and convenient to connect to a vacuum hose to both turn an oscillating sanding plate or pad and to draw collected dust therethrough for passage to a collection container.

The present invention is in a new and improved vacuum air flow air driven oscillating sander that includes a bent hollow tube that connects to a hollow pole whereon the sander is mounted and is connected to pass the vacuum air flow therethrough and into a vacuum hose to vent that flow into a collection container. The bent hollow tube is arranged to turn axially at is connection to the top of the sander body at a collar that has a number of radially spaced cavities formed therein that selectively receive stub pivots fitted therein that are formed to extend oppositely from a ball end of the bent hollow tube. A cap having a center hole therein is provided to fit over the bent tube and is for turning onto the collar to maintain coupling of the stub pivots in the selected radially spaced cavities, allowing the bent hollow tube to be turned relative to the collar end and to be locked in place. So arranged, the angle of the sander forms to a wall can be adjusted by a repositioning of the stub pivots in the radially spaced cavities and turning the cap onto the collar.

Further unique to the invention, the sander includes a turbine that is mounted by a bearing assembly onto a stanchion located within a sander housing, and provides, by a passage formed through the housing into a bearing assembly cavity located within the stanchion, for a flow of ambient air to the bearings during operation and precludes contamination of the bearing assembly by dust entrained in the vacuum flow that has passed over the sanded surface, greatly extending bearing life over earlier air driven sanders that have exposed their turbine bearings to the dust filled vacuum air flow.

Additionally, the sander body of the invention exhibits a significantly reduced profile by an incorporation of a split design turbine that allows the bearing assembly to be conveniently fitted into and assembled in a bearing cavity in a shanchion formed in the housing. The construction of the turbine as a split design provides two turbine sections, with a lesser height upper section arranged to cap over the greater height lower section, simplifying mounting of the turbine bearing assembly in the bearing assembly cavity prior to fitting the assembled turbine thereto. The turbine is turned by passage of the vacuum air flow there through that is first passed through balanced air intakes where air is pulled across the surface being sanded and into the housing opposite ends, applying a balanced driving force to drive the turbine. The turbine, at its lower end, is connected through an eccentric to oscillate a sanding pad whereto a section of sanding material is releasably attached.

The sanding pad is formed as a plate, and the entire sander is assembled and held together by four (4) screws that are each turned through spiders attached to corners of the inner surface of the plate that are turned into the housing lid or top, maintaining the sander in its assembled state.

Still other benefits and advantages of the invention will become apparent to those skilled in the art to which it pertains upon a reading and understanding of the following detailed specification.

DESCRIPTION OF THE DRAWINGS

The invention may take physical form in certain parts and arrangements of parts, and a preferred embodiment of which will be described in detail in this specification and illustrated in the accompanying drawings which form a part hereof.

DETAILED DESCRIPTION

Figure 1:
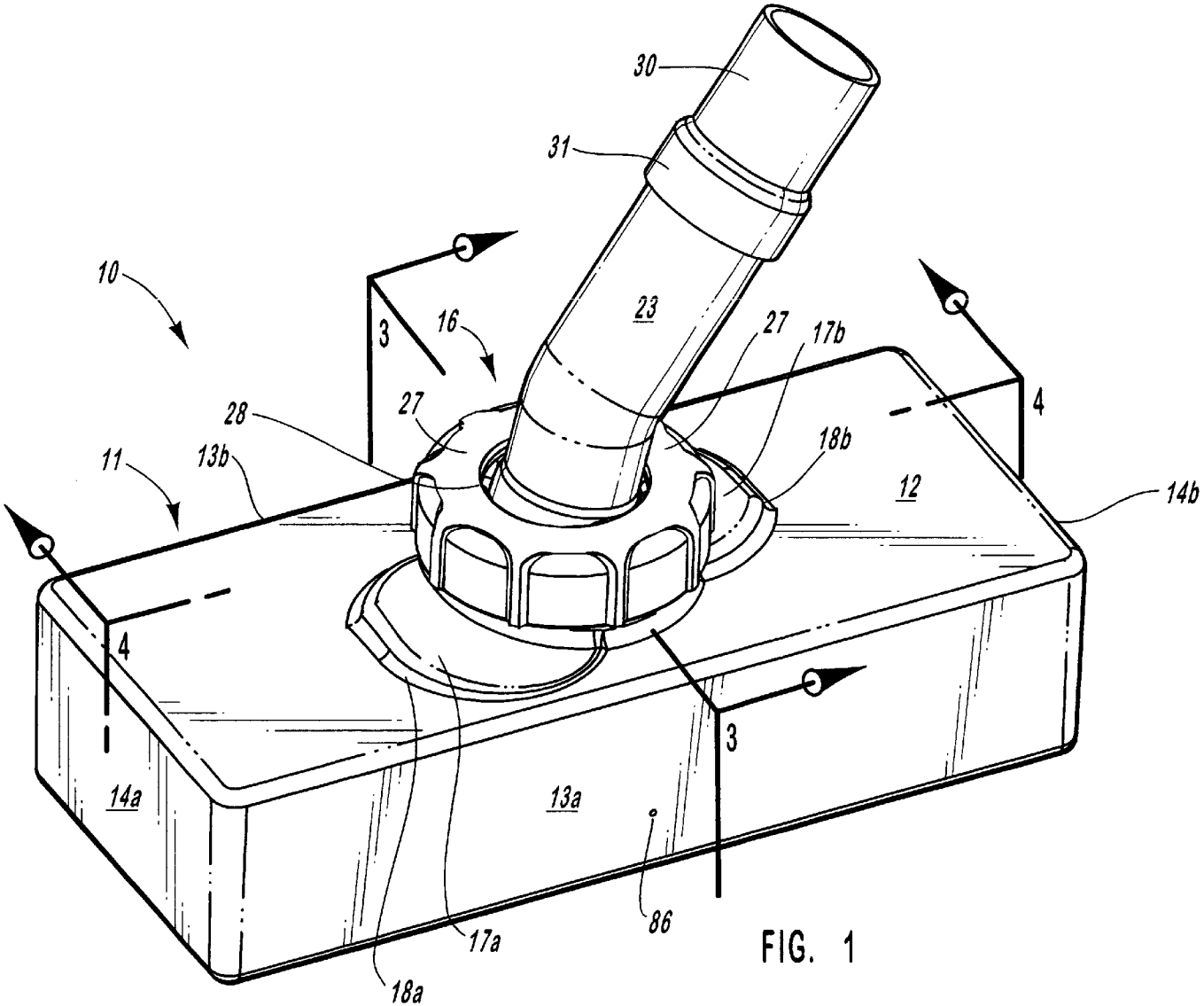
FIG. 1 is a perspective view taken from a left side and front of a vacuum sander of the invention, showing a bent tube end extending out from a housing top section collar and cap.

The invention is herein described with reference to a preferred embodiment shown in the accompanying drawings, with FIG. 1 showing a front elevation perspective view of the low profile vacuum driven sander 10 of the invention, hereinafter referred to as sander. As shown in the Figs., the sander 10 includes a housing 11, having front, rear and side walls 13*a*, 13*b*, 14*a*, and 14*b*, respectively, extending at right angles from the top edges, forming a narrow rectangular box configuration having, as shown in FIGS. 3 and 4 an open bottom 15 and whereover a flat top 12 is fitted. A coupling collar assembly 16 is shown in FIGS. 1,3 and 4, fitted into the center of the top 12 that includes, as shown in FIGS. 2 and 8, a pair of turbine ducts 17*a* and 17*b* that are shown as flat raised sections that extend oppositely from steps 18*a* and 18*b* to an opening in the center of the flat top 12, and are open, as shown in FIGS. 1, 2, 4 through 6 and 8, to serve as ducts that pass and direct turbine exhaust air flow into a hollow bent tube 23 that is preferably bent at an angle of approximately twenty two and one half (22½) degrees, and wherethrough the flow is vented into a vacuum hose or tube.

Figure 2:
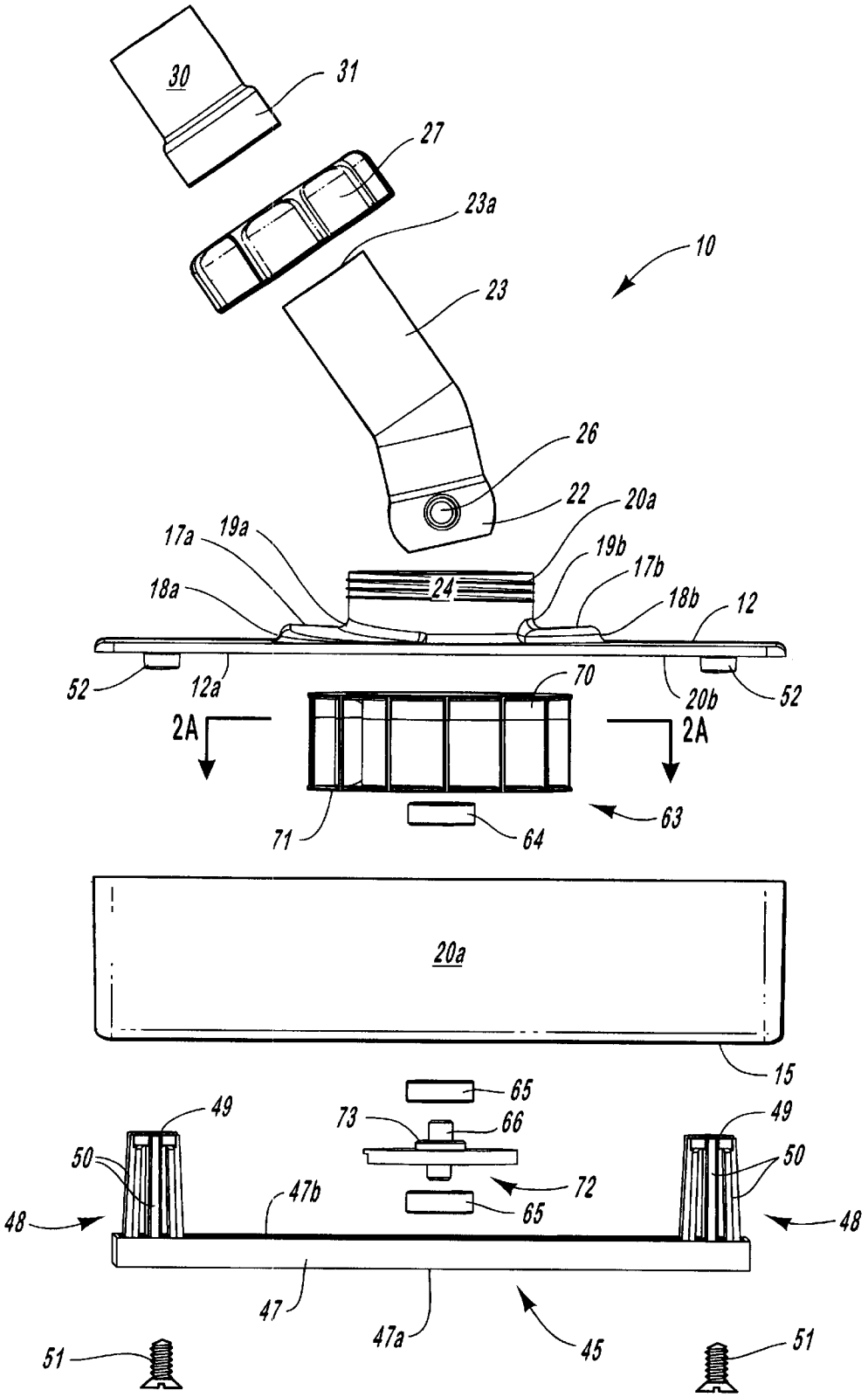
FIG. 2 is a side elevation exploded view of the vacuum sander of FIG. 1.
Figure 3:
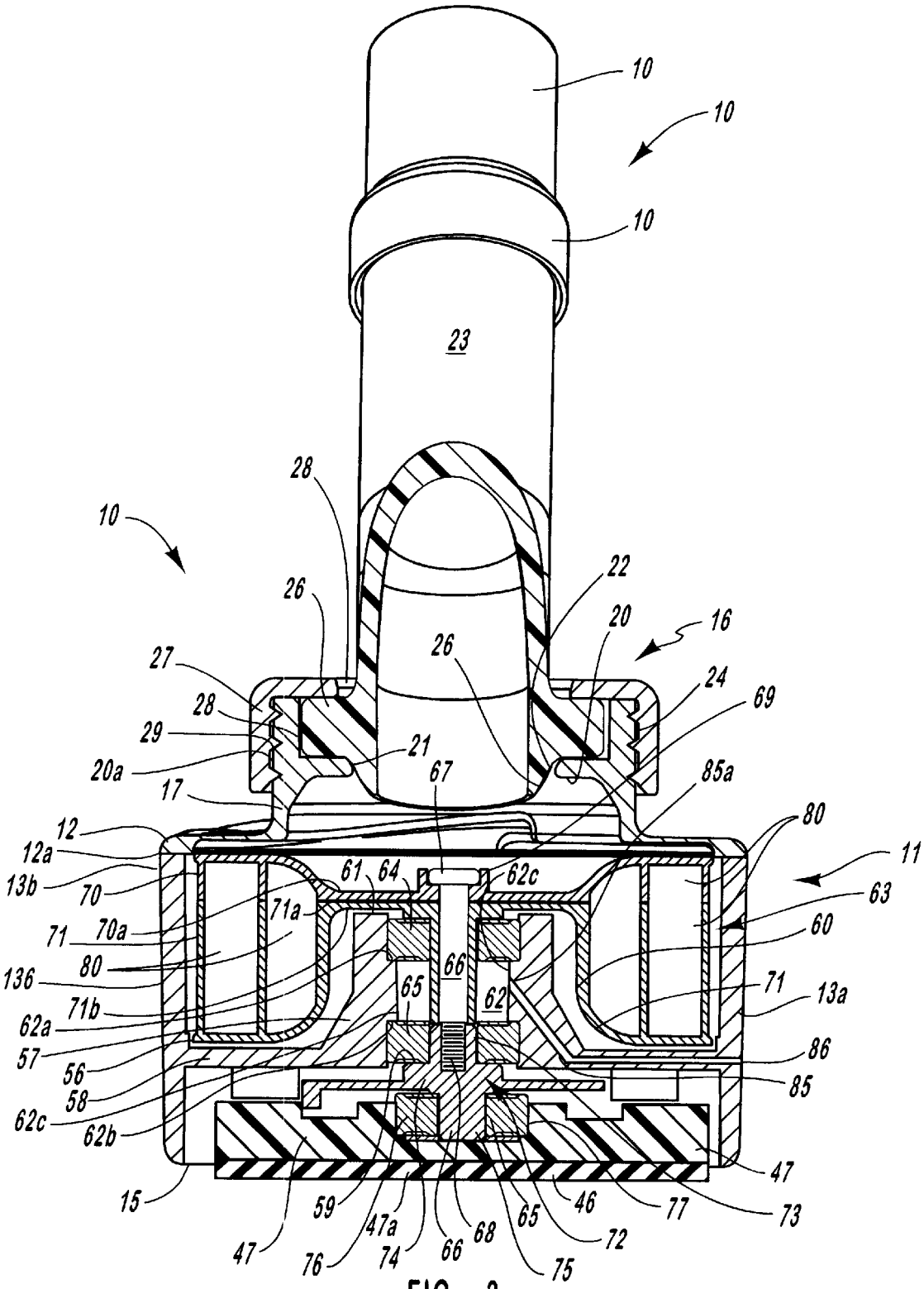
FIG. 3 is a profile sectional view taken along the like 3—3 of FIG. 1.
Figure 4:
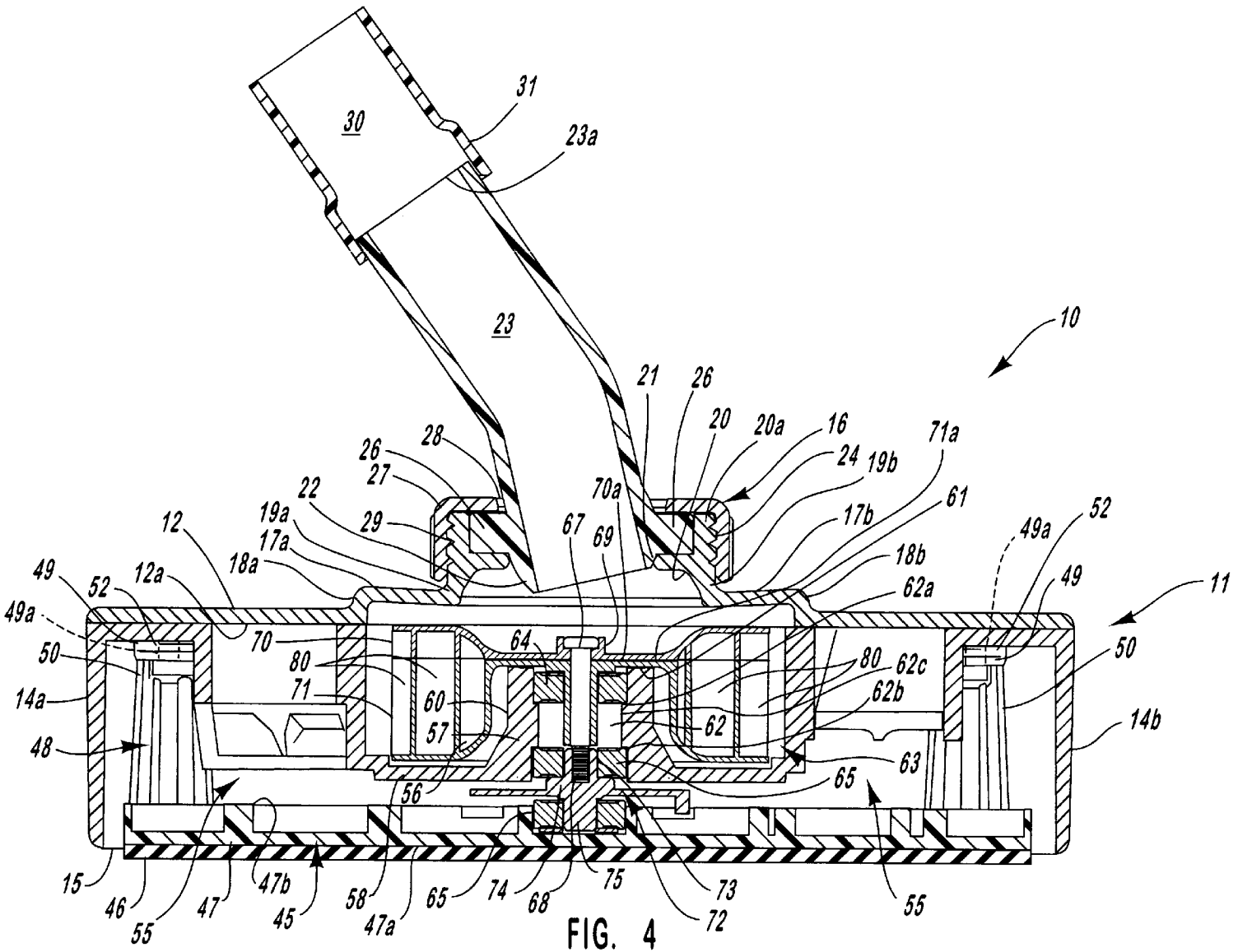
FIG. 4 is a front elevation sectional view taken along the line 4—4 of FIG. 1.
Figures 5, 6, 7:
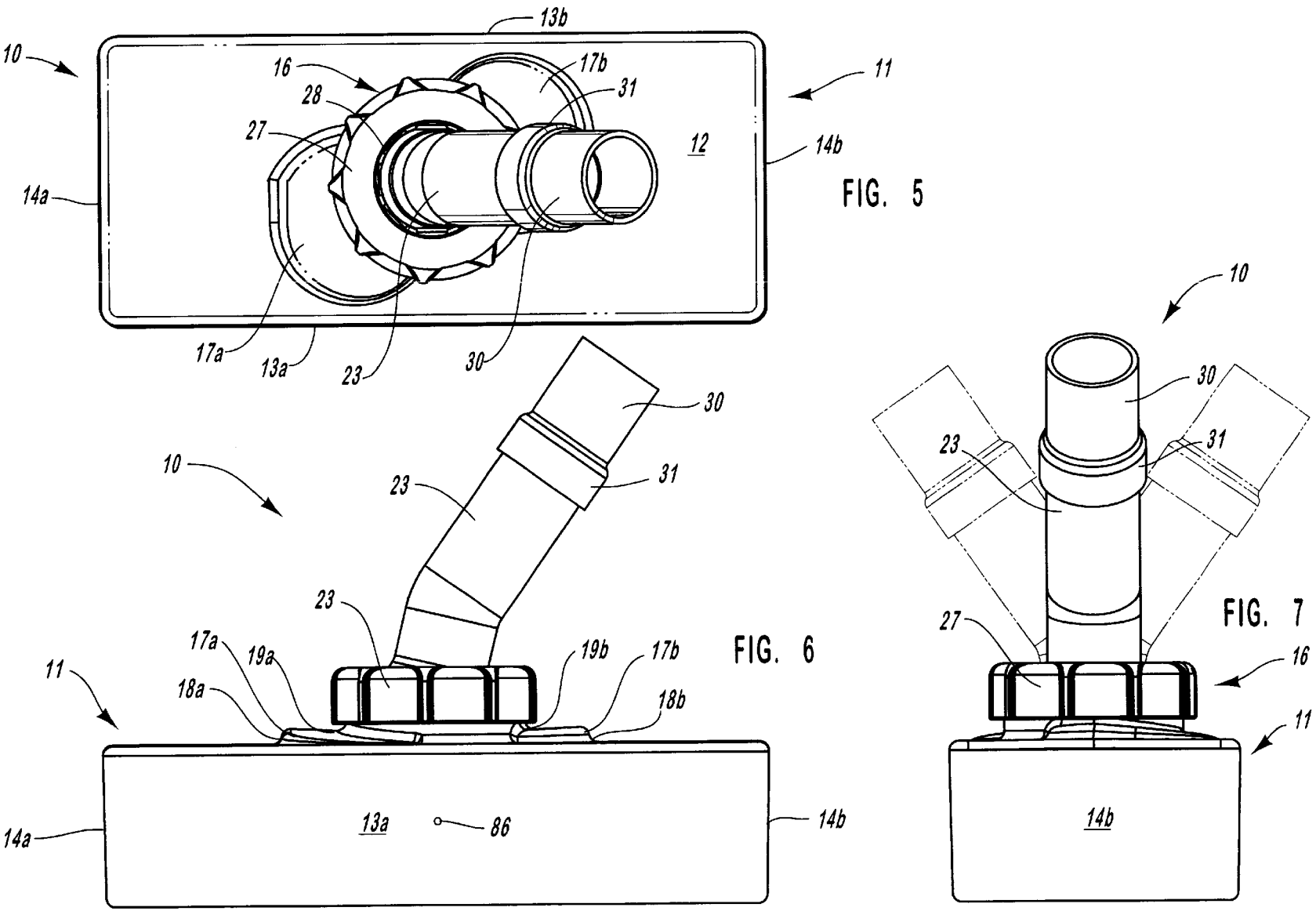
FIG. 5 is a top plan view of the vacuum sander of FIG. 1.
FIG. 6 is a front elevation view of the vacuum sander of FIG. 1.
FIG. 7 is a side elevation view of the vacuum sander of FIG. 1, and showing in broken lines, the bent tube coupling neck pivoted around its pivot coupling to the sander collar.

The turbine ducts 17*a* and 17*b*, as shown best in FIGS. 1 and 5, are slightly greater than half semi-spherical sections and terminate, as shown best in FIGS. 1, 2 and 6, in stepped up sections 19*a* and 19*b* that join into dome 20, as shown best in FIGS. 3 and 4. The dome 20 has a center hole 21 formed therethrough, with the edge of which hole 21 to serve as a seat whereover a ball end 22 of a bent exhaust tube 23 travels. The ball end 22 to maintain sealing engagement with the hole 21 edge, with the ball and its edge serving as a ball valve. So arranged, the turbine ducts 17*a* and 17*b* direct the turbine exhaust flow into the dome 20 that then directs that flow into the bent exhaust tube 23, wherefrom it is exhausted through a connecting hose or tube into the collection container, not shown.

Figure 8:
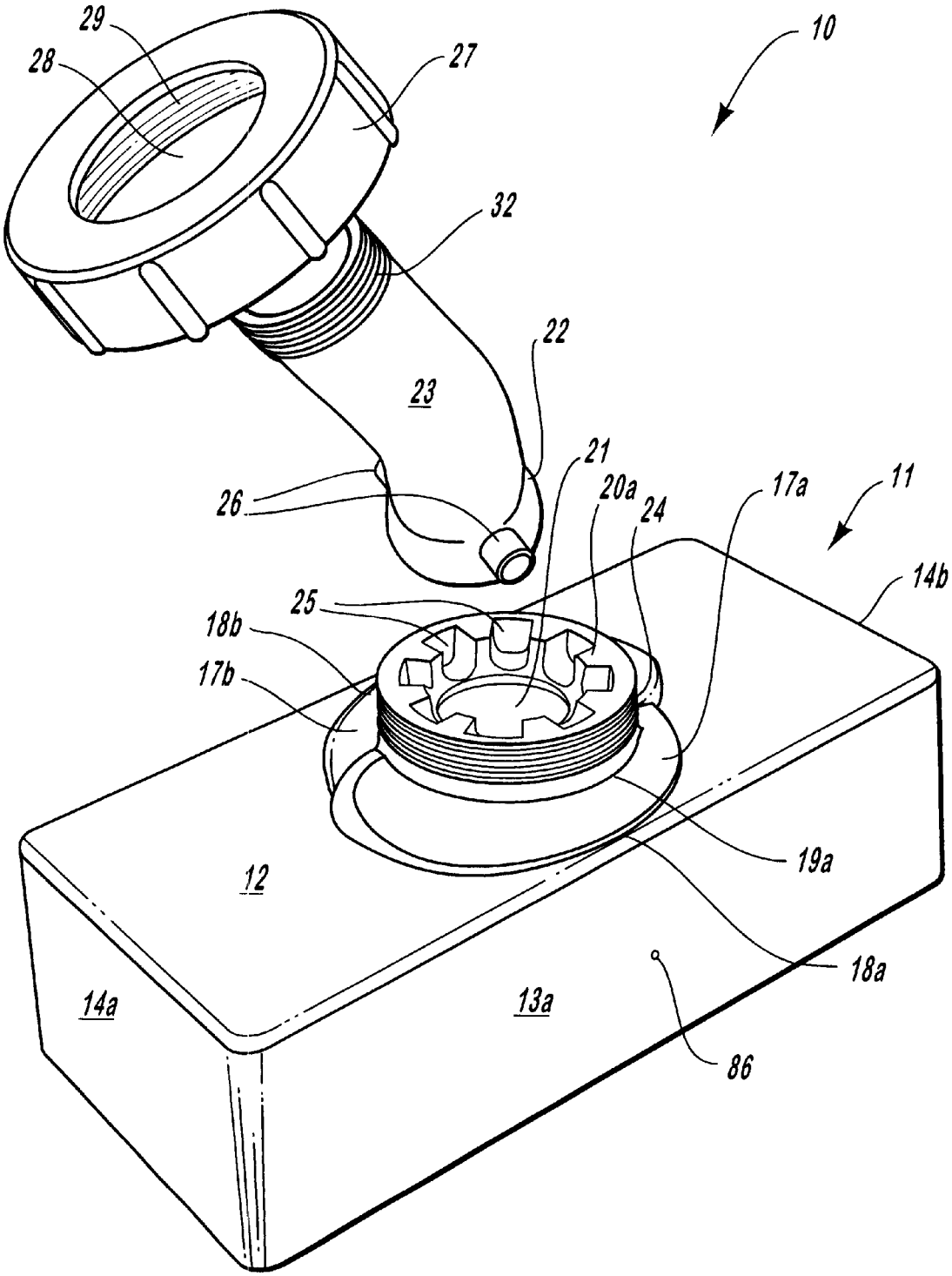
FIG. 8 is a view like that of FIG. 1 showing the collar mounted onto the sander top to include radially spaced slots formed therein that are to receive stub pivots formed to extend oppositely outwardly from a ball end of the bent tube coupling neck, and with the bent tube and cap shown exploded from the collar.

An upper outer portion of the walls of which dome 20, as shown best in FIG. 8, is formed into collar 20*a* that has outer threads 24 and wherethrough the hole 21 is formed. Around the edge of which hole 21 are formed a number of radially equal spaced pivot cavities 25, shown as half cylindrical sections that are to individually receive each of a pair of stub pivots 26 fitted therein. The stub pivots 26 extend oppositely outwardly from the ball end 22 of the bent tube 23, and are to fit into individual pivot cavities 25. So arranged, as shown best in FIGS. 3 and 4, with the pair of stub pivots 26 each fitted into a pivot cavity 25, a cap 27 having a center hole 28 formed therein is slid along the bent tube 23 to where threads 29 thereof can be turned onto the outer threads 24 of the collar 20*a*. With cap 27 turned onto collar 20*a* the positioning of the stub pivots 26 in the selected pivot cavities 25 is maintained, setting the positioning of the sander body 11 relative to the bent tube 23. Which positioning, however, is preferably not rigid in that the diameter of the hole 28 through the cap 27 is selected to be somewhat larger or greater that the bent tube 23 diameter, as shown in FIGS. 1 and 5, allowing for some pivotal movement between which sander body 11 and bent tube 23, as during use of the sander, to minimize damage to the coupling should the sander "stick" to the wall surface. So arranged, the sander body 11 is selectively positionable relative to the bent tube 23 to facilitate the sander 10 being moved up and down or side to side or at an angle therebetween, as the operator desires. The bent tube 23 preferably has its end 23*a*, shown in FIG. 2, fitted into a coupling end 31 of a vacuum pipe 30, as shown in FIGS. 1 through 7, which coupling can be by providing interior threads, not shown, formed in the coupling end 31 for turning onto threads 32 formed in the bent tube 23 end 23*a*, as shown in FIG. 8, providing a rigid coupling therebetween. Or, as required, to further facilitate sander back and forth or up and down travel, the coupling can be such as to allow partial or full axial rotation of the vacuum pipe 30 to the bent tube 23, within the scope of this disclosure.

The sander 10 is equipped with a sanding pad 45, as shown best in FIG. 2, that, as shown in FIGS. 3 and 4, is of a lesser length and width than the distances between the inner surfaces of housing end walls 14*a* and 14*b* and front and rear walls 13*a* and 13*b*, leaving a space therebetween that allows for passage of a vacuum air flow pulled therearound. Which vacuum air flow will both turn the turbine 63, will pick up sanding dust off of the surface being sanding and entrain that dust in the vacuum air flow, as discussed below. To provide sanding, the sanding pad 45 is fitted with a section of sanding material 46, as shown in FIGS. 3 and 4, that is maintained thereto, preferrably with Velcro type fasteners, adhesive sections, or the like, and the sanding pad 45 is oscillated through an eccentric 72 that is turned by the turbine 63, as set out below.

The sanding pad 45, shown best in FIGS. 2, 3 and 4, includes a stiff flat rectangular plate 47 having a front or outer face 47*a* arranged for releasably mounting sheets of sand paper, or other sanding material, thereover, and includes, mounted to the corner of a rear or inner face 47*b*, as shown best in FIG. 3, identical spiders 48 that each having a head end 49 wherein a center hole is formed, and include like spaced straight legs 50 extending from around the head end 49 whose opposite ends are secured to the plate inner face 47*b* surface. Which legs 50 are preferably formed from a semi-rigid plastic, or other appropriate light weight stiff material, to flex so as to allow the sanding pad 45 to oscillate, so as to move orbitally, while supporting the pad against collapse when pressure is applied to force the sanding pad against a surface to be sanded. For mounting the sanding pad 45 to the sander body 11, as shown in FIG. 2, screws 51 are each aligned for fitting through holes formed through the sanding pad 45, preferrably at the corners thereof. With the holes each aligning to pass a screw 51 into a hole 49*a* formed through a spider end, as shown in broken lines in FIG. 4, and are turned into a pier 52 that is formed in to project from the bottom surface 12*a* of the flat top 12, shown also in FIG. 2. So arranged, with each of the spiders 48 each connected to a pier 52 at its head end 49, the sanding pad 45 is suspended by the spider legs 50 to allow the sanding pad 45 to oscillate orbitally when moved by operation of the turbine 63 turning an eccentric 72, as set out below. Which connection of the sanding pad 45 spiders to the undersurface 12*a* of the flat top 12 is a last step in the assembly process where the flat top 12 and sanding pad are fitted to the housing 11, positioned within the walls 13*a*, 13*b*, 14*a* and 14*b*, following the installation of the turbine and bearing assembly in the housing 11, as set out herein below.

The housing 11 is preferably formed, as by molding, or like methods, to include air intakes or air inlet cavities 55 that are arranged in both ends of the housing 11, and are to direct inlet air passing around the sanding pad 45 into inwardly sloping sections within the housing 11 that vent into a turbine chamber 56, striking blades 80 of the turbine 63. The inlet flows are of approximately the same volume, providing a balanced driving force that turns the turbine 63. The air inlet cavities 55 are each formed in the housing along with the turbine chamber 56 that, as shown best in FIG. 3, is a cavity formed around a center stanchion 57 that projects upwardly from a chamber floor 58 that is formed across the housing interior and is spaced upwardly from where the sanding pad 45 is positioned. Which housing interior chamber floor 58 has the air inlet cavities 55 and a center hole 59 formed therein that an eccentric 72 is fitted in, as set out below.

The stanchion 57, as shown in FIGS. 3 and 4, provides an inner turbine chamber wall 60, is flat across its top surface 61 and includes a bearing cavity 62 formed through that top surface that extends downwardly to the chamber floor 58 center hole 59. The bearing cavity 62 is to receiving a pair of like upper and lower turbine bearings 64 and 65 of turbine 63 that align to pass a turbine axle 66 journaled therethrough. To accommodate which upper and lower turbine bearings 64 and 65, respectively, the bearing cavity 62 is stepped inwardly at 62*a* and 62*b*, providing a ledge 62*c* therebetween, for maintaining bearing spacing, and whose opposite ends support each of the turbine bearings.

The turbine axle 66, shown in FIGS. 3 and 4, includes a flat head end 67 and is threaded at its opposite end 68. With the turbine axle passed through a center hole formed through center plates of both the turbine top and bottom sections 70 and 71 and has its lower threaded end 68 turned into a threated top end 73 of eccentric 72. The axle head end 67 fits in a cup 69 that is formed as a raised section at the center of turbine top section 70 center plate 70*a*, with the axle 68 to pass through the turbine lower section 71 center plate 71*a* of turbine 63 and is turned into the eccentric 72 top end 73. The eccentric 72 is preferably a single unit formed with the threaded top end 73 wherein the turbine axle 66 threaded end 68 is turned, that extends upwardly at approximately a right angle from the center of a top surface of a disk 74 and includes an axle pin 75 that extends downwardly, at approximately a right angle, from the bottom surface of which disk 74 and is off-set from the disk center. The axle pin 75 is fitted into a bearing 76 that is maintained in a center cavity formed into the inner face 47*b* of the sanding pad 45. So arranged, turning of the turbine 63 turns the turbine axle 66 that is coupled to the eccentric 72 top end 73 to turn the eccentric axle pin 75 that is journaled in the sanding pad 45 bearing 76, thereby imparting an oscillating motion to the sanding pad that is moved along an orbital path, in turn, moving a sheet of sand material attached thereto over a surface that it is in contact with, sanding that surface.

The turbine 63 is a split design, formed in two sections, a lower of which sections 71 has a greater height than the height of the top section 70. So arranged, the bearing assembly including the turbine axle bearings 64 and 65, can be easily installed in the bearing cavity 62, the top axle bearing 64 being dropped into the top end of the bearing cavity 62 sliding along the stepped section 62*a* to come to rest on the top lip of the ledge 62*c*, with the lower axle bearing 65 to be fitted through the housing 11 open bottom center hole 59 to travel into the bearing cavity, sliding along the lower stepped section 62*b* to where its edge engages the bottom lip of ledge 62*c*.

The turbine 63 is fitted, as shown in FIGS. 3 and 4, through the open top of housing 11 to rest on the top of the top surface 61 of the stanchion, with a hole through the collar 69 to receive the axle 66 fitted therethrough to where the axle top end 67 is nested in the collar 69, and whereafter the eccentric 72 top end 73 threaded cavity is turned onto the turbine axle 66 threaded end 68, securing the turbine 63 to the eccentric. Thereafter, with the sanding pad 45 bearing 76 seated in the bearing cavity 77 that is formed in the sanding pad inner face 47*b*, the eccentric axle pin 75 is fitted into which bearing 76 and the sanding pad 45 and top 12 are installed to the body 11, as set out above.

Figure 2A:
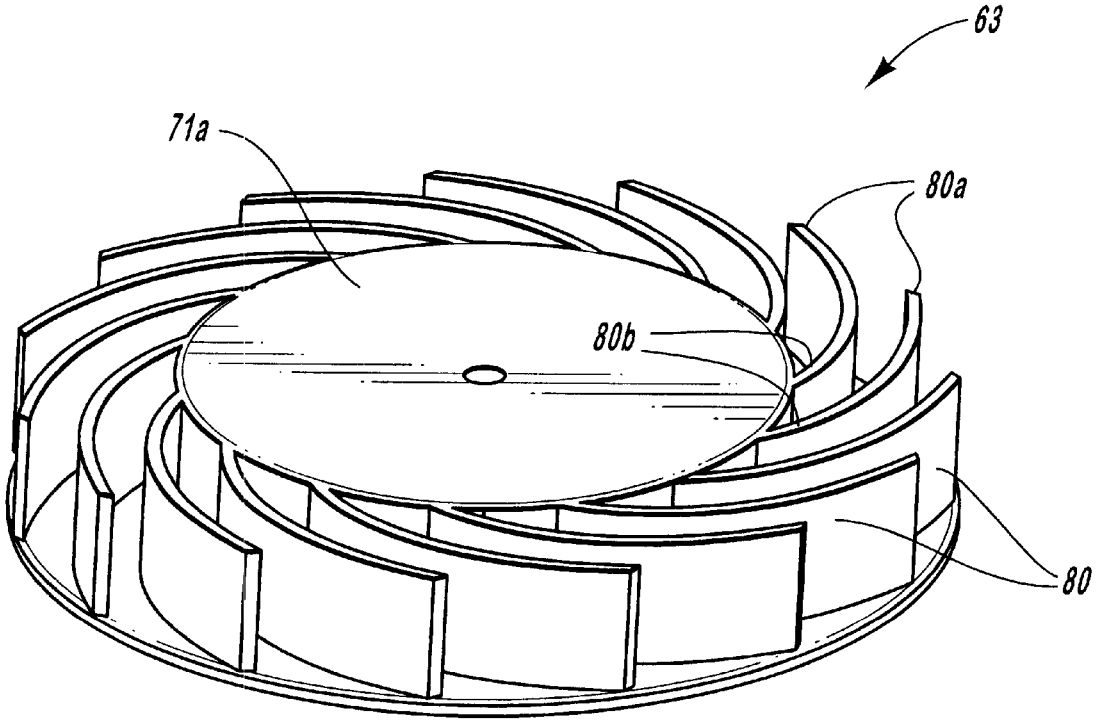
FIG. 2A is a top plan sectional view taken along the line 2—2 of FIG. 2 of the turbine lower section, showing the turbine as having the equal radially spaced turbine blades.

The turbine 63 is preferably formed from a hard plastic material, metal, or the like, as the described upper and lower turbine halves 70 and 71, as shown in FIGS. 2, 3 and 4, that are joined together as by an adhesive bonding, by welding, brazing, or the like, with the assembly then fitted, as shown best in FIG. 3, into the housing turbine chamber 56. So arranged, the turbine top half rests on a top surface of center plate 71*a* of the lower turbine half 71, and the top and bottom sections of turbine blades 80 are joined, as shown in FIGS. 3 and 4, along their contacting surfaces. So arranged, the blades 80 are spaced apart equal distances and are curved to each receive the inlet vacuum air flow at their forward edges 80*a* that travels therealong to their hub ends 80*b*. The curve of which blades 80 is shown best in FIG. 2A. The spacing distance between which blades 80 is shown as reducing from their inlet ends 80*a* to their exhaust ends 80*b*.

In practice, an inlet vacuum flow is pulled around the sanding pad 45 to pass, as a balanced air flow, through the air inlet cavities 55 and into the turbine chamber 56 wherein the turbine 63 is journaled to upper and lower bearings 64 and 65, with the turbine blades 80 receiving the air flow and reacting thereto by turning, to turn also the eccentric 72 that turns an off-set axle pin 75 fitted in a bearing 76 mounted in the sanding pad 45. The sanding pad is thereby moved through an orbital path, sanding a surface. With the inlet vacuum air flow picking up sanding dust off from a working surface during its passage around the sanding pad 45, that then passes through turbine ducts 17*a* and 17*b* to drive the turbine 63, with that vacuum flow, with entrained dust collected therein, is then exhausted through the bent tube 23, passing into the vacuum hose 30 and then to a collection container.

The vacuum air flow is, of course, contaminated with sanding dust that is entrained therein during its passage across the sanded surface and around the sanding pad 45 edges. A portion of such dust, in earlier sanders, has tended to find its way into the bearing assembly to, in short order, contaminate the bearings and greatly curtail turbine turning, thereby severely limiting the useful life of such sander and requiring, if possible, that the sander be taken apart and the collected dust removed from the bearings. The invention recognizes and solves this problem of dust contamination of the turbine bearings by effectively closing off access to the bearing cavity 62. This is accomplished by the arrangement of the fitting of the turbine axle 66 head end 67 in the upper turbine half plate 70*a* collar 69 and turning of the axle threaded end 68 into the eccentric top end 73 so as to provide a tight clamping together of the upper and lower turbine halves plates 70*a* and 71*a*. Thereby clamping the upper turbine bearing 64 between the undersurface of the lower turbine half plate 71*a* and the upper edge of the stepped section 62*c* of the bearing cavity. The lower turbine bearing 65 top edge is thereby clamped against the lower edge of the stepped section 62*c* and which bearing 65 has its lower edge held against the eccentric disk 64 top surface. So arranged, dust is discouraged from passage into the bearing cavity 62. Further, and significant to the invention, to preclude dust travel into which bearing cavity 62, a passage 85 is formed, as shown in FIG. 3, from a passage end 85*a* in the bearing cavity 62, that is downwardly sloping through the stanchion 57 and then become a horizontal passage through the chamber floor 58, and opens at opening 86 through the housing 11 front 13*a*, as shown also in FIGS. 1, 6 and 8. So arranged, the vacuum inlet flow through into the sander 10 creates less than ambient conditions within housing 11 and the bearing cavity 62, causing an air flow to be pulled through a opening 86 in the housing wall 13*a* that travels through the passage 85 that is formed through the chamber floor 58 and slopes upwardly through the stanchion 57 and opens at 85*a* into the bearing cavity 62. A positive pressure is thereby created within the bearing cavity 62 that blocks dust in the vacuum flow from traveling therein and provides air cooling to the bearings 64 and 64. Additionally, this passage 85 can be used to pass oil, fed as drops into the opening 86, that travel into the bearing cavity, to lubricate the turbine bearings 64 and 65, providing bearing lubrication. Accordingly, by passing a clean air flow from without the sander into the bearing cavity 62 through passage 85, and by a periodic introduction of oil through opening 86, the sander 10 can enjoy a long and useful life.

A preferred embodiment of my invention in a low profile vacuum driven sander has been shown and described above. It will, however, be apparent to one skilled in the art that the above described embodiment may incorporate changes and modifications without departing from the general scope of the invention, which invention, it should be understood, is intended to include all such modifications and alterations in so far as they come within the scope of the appended claims and/or a reasonable equivalence thereof.

I claim:

1. A vacuum driven sander comprising, a housing formed from a rigid material to include internal air inlet passages that are connected to a turbine chamber wherein a stanchion is centered that has a bearing assembly cavity formed therein, and air exhaust passages leading from said turbine chamber to vent through a housing top section; a vacuum hose coupling with a pivotal mounting for connection into said housing top section to receive the vacuum air flow exhausted from said turbine chamber; a turbine and a turbine bearing assembly for mounting in said bearing assembly cavity, with said turbine to turn therein; an eccentric connected to be turned by said turbine; a sanding pad that includes, on an outer face, sanding material couplers, whereto a section of a sanding material is releasably secured, and includes, on an inner face, a plurality of flexing couplers for joining said sanding pad to an undersurface of said housing top section that are secured to said sanding pad inner face, suspending said sanding pad from said housing top section, and with said sanding pad including a bearing for receiving an off center end of said eccentric whereby turning of said turbine and eccentric will impart an orbital motion to said sanding pad; and a port formed through said housing outer surface, passing through said stanchion, and into said bearing assembly cavity between a pair of turbine shaft bearings to pass outside air at ambient pressure therethrough.

2. The vacuum driven sander as recited in claim 1, wherein the housing is formed as a single rectangular unit to contain the inlet air passages, turbine chamber, stanchion with bearing assembly cavity, and is formed to receive a housing top section fitted thereover wherein are formed air exhaust chambers that are open to said turbine chamber; and the sanding pad is formed as a flat narrow section to receive replaceable sections of sanding material releasably secured to its outer surface and includes, at corners of a top surface of the inner face, as the individual flexing couplers, spiders that each have a top with a screw hole formed therethrough and with equal spaced legs extending from the spider top undersurface that connect, at their opposite ends to their couplings to said top, onto the sanding pad inner face, with the spider tops each to receive a screw turned therethrough and into the housing top section, mounting said sanding pad to said housing top section so as to allow said sanding pad through said spiders to be oscillated.

3. The vacuum driven sander as recited in claim 2, wherein the housing is formed by molding methods from a flat section of stiff material and the port is formed as a continuous passage from the housing outer surface to open into the bearing assembly cavity.

4. The vacuum driven sander as recited in claim 1, wherein the housing top section is a flat section of stiff material formed to fit over the top edges of front, rear and side walls of the housing, has a center hole formed therethrough and includes, formed therein, a pair of spaced turbine ducts that receive the vacuum air exhaust flow from the turbine and direct that flow into the vacuum hose coupling.

5. The vacuum driven sander as recited in claim 4, wherein the vacuum hose coupler includes a collar having external threads that is formed on the center of the housing top section, at the junction of the spaced turbine ducts, is open therethrough and includes radially spaced pivot cavities formed therein around the opening that are identical and are individually to receive individual stub pivots; an exhaust tube that is bent at a center section and includes a pair of stub axles extending outwardly from opposite sides of a ball end of said exhaust tube, and a coupling collar mounted to said exhaust tube end opposite to said ball end for connection to a vacuum tube; and a mounting cap having a center opening formed therethrough to pass said exhaust tube, and is threaded to turn over said collar external threads.

6. The vacuum driven sander as recited in claim 5, wherein the pivot cavities and stub axles are formed to fit together and each has a cylindrical shape; and the exhaust tube is bent at an angle of approximately twenty two and one half (22½) degrees.

7. The vacuum driven sander as recited in claim 5, wherein the coupling collar is a pivot mounting to allow the exhaust tube to pivot around the vacuum tube; and the mounting cap center opening has a significantly greater diameter than that of the exhaust tube, allowing limited pivotal movement of said exhaust tube stub axles in said pivot cavities.

8. The vacuum driven sander as recited in claim 1, wherein the internal air inlet passages are identically formed into opposite end portions of the housing, with each to pull a like volume of air therethrough, providing a balanced air flow that is directed into opposite sides of the turbine.

9. The vacuum driven sander as recited in claim 1, wherein the turbine is a split design formed in upper and lower sections, where the lower section has the greater height than the upper section with the upper section for fitting, as a covering over, said lower section, and said upper and lower sections include center plates as contacting surfaces for their assembly, which said contacting plates include aligned turbine axle holes wherethrough a turbine axle is fitted, and a lower end of said turbine axle is secured to a head or top end of the eccentric.

10. The vacuum driven sander as recited in claim 9, wherein turbine blade section of the turbine upper and lower sections are joined along their mating edges; and the turbine axle is a pin having a broad flat top end and is threaded at its lower end for turning into the eccentric top end.

11. The vacuum driven sander as recited in claim 10, further including a cup having a center opening therethrough that is secured across the axle hole formed through the turbine upper section and is to receive the turbine axle broad flat top end; and the eccentric includes a center disk wherefrom the eccentric head or top end extends upwardly and includes an eccentric axle pin mounted off center to said center disk and extending downwardly therefrom to fit into a bearing mounted in a cavity that is formed in the sanding pad inner face.

12. A vacuum driven sander comprising, a housing formed from a rigid material as a single rectangular unit containing a turbine chamber, stanchion with bearing assembly cavity and inlet air inlet that are connected into said turbine chamber wherein said stanchion is centered, and air exhaust passages that lead from said turbine chamber to vent through a housing top section; a housing top section for fitting over said single rectangular unit that includes air exhaust chambers that open into said turbine chamber and include a vacuum hose coupling with a pivotal mounting for connection to receive the vacuum air flow exhausted from said turbine chamber; a turbine and a turbine bearing assembly for mounting in said bearing assembly cavity, with said turbine to turn therein; an eccentric connected to be turned by said turbine; a rectangular sanding pad that includes, on an outer face, sanding material couplers to releasably mount sections of sanding material, and includes, at corners on an inner face, spiders as flexing couplers that each have a top with a screw hole formed therethrough and have equal spaced legs extending from an under surface of said spider top that connect, at their opposite ends onto said sanding pad inner face, said spider screw holes to each receive a screw fitted therethrough that is turned into said housing top section, suspending said sanding pad from said housing top section, and said sanding pad includes a bearing for receiving an off center end of said eccentric whereby turning of said turbine and eccentric will impart an orbital motion to said sanding pad suspended from said spiders; and a port formed through said housing outer surface into said bearing assembly cavity for passing ambient air therethrough.

13. The vacuum driven sander as recited in claim 12, wherein the housing is formed by molding methods from a flat section of stiff material and the port is formed as a continuous passage from the housing outer surface to open into the bearing assembly cavity.

14. The vacuum driven sander as recited in claim 12, wherein the housing top section is a flat section of stiff material formed to fit over the top edges of front, rear and side walls of the housing, has a center hole formed therethrough and includes, formed therein, a pair of spaced turbine ducts that receive the vacuum air exhaust flow from the turbine and direct that flow into the vacuum hose coupling.

15. The vacuum driven sander as recited in claim 14, wherein the vacuum hose coupler includes a collar having external threads that is formed on the center of the housing top section, at the junction of the spaced turbine ducts, is open therethrough and includes radially spaced pivot cavities formed around the opening that are identical and are individually to receive individual stub pivots; an exhaust tube that is bent at a center section and includes a pair of stub axles extending outwardly from opposite sides of a ball end of said exhaust tube, and a coupling collar mounted to said exhaust tube end opposite to said ball end for connection to a vacuum tube; and a mounting cap having a center opening formed therethrough to pass said exhaust tube, and is threaded to turn over said collar external threads.

16. The vacuum driven sander as recited in claim 15, wherein the pivot cavities and stub axles are formed to fit together and each has a cylindrical shape; and the exhaust tube is bent at an angle of approximately twenty two and one half (22½) degrees.

17. The vacuum driven sander as recited in claim 15, wherein the coupling collar is a pivot mounting to allow the exhaust tube to pivot around the vacuum tube; and the mounting cap center opening has a significantly greater diameter than that of the exhaust tube, allowing limited pivotal movement of said exhaust tube stub axles in said pivot cavities.

18. The vacuum driven sander as recited in claim 12, wherein the internal air inlet passages are identically formed into opposite end portions of the housing, with each to pull a like volume of air therethrough, providing a balanced air flow that is directed into opposite sides of the turbine.

19. The vacuum driven sander as recited in claim 12, wherein the turbine is a split design formed in upper and lower sections, where the lower section has the greater height than the upper section with the upper section for fitting, as a covering over, said lower section, and said upper and lower sections include center plates as contacting surfaces for their assembly, which said contacting plates include aligned turbine axle holes wherethrough a turbine axle is fitted, and a lower end of said turbine axle is secured to a head or top end of the eccentric.

20. The vacuum driven sander as recited in claim 19, wherein turbine blade section of the turbine upper and lower sections are joined along their mating edges; and the turbine axle is a pin having a broad flat top end and is threaded at its lower end for turning into the eccentric top end.

21. The vacuum driven sander as recited in claim 20, further including a cup having a center opening therethrough that is secured across the axle hole formed through the turbine upper section and is to receive the turbine axle broad flat top end; and the eccentric includes a center disk wherefrom the eccentric head or top end extends upwardly and includes an eccentric axle pin mounted off center to said center disk and extending downwardly therefrom to fit into a bearing mounted in a cavity that is formed in the sanding pad inner face.

22. A vacuum driven sander comprising, a housing formed from a rigid material to include identical internal air inlet passages formed into opposite end portions of the housing, with each air inlet passage to pull a like volume of air therethrough, providing a balanced air flow and are connected to opposite sides of a turbine chamber wherein a stanchion is centered that has a bearing assembly cavity formed therein, and air exhaust passages leading from said turbine chamber to vent through a housing top section; a vacuum hose coupling with a pivotal mounting for connection into said housing top section to receive the vacuum air flow exhausted from said turbine chamber; a turbine and a turbine bearing assembly for mounting in said bearing assembly cavity, with said turbine to turn therein; an eccentric connected to be turned by said turbine; a sanding pad that includes, on an outer face, sanding material couplers, whereto a section of a sanding material is releasably secured, and has, on an inner face, a plurality of flexing couplers for joining said sanding pad to an undersurface of said housing top section that are secured to said sanding pad inner face, suspending said sanding pad from said housing top section, and said sanding pad includes a bearing for receiving an off center end of said eccentric whereby turning of said turbine and eccentric will impart an orbital motion to said sanding pad; and a port formed through said housing outer surface into said bearing assembly cavity for passing ambient air therethrough.

23. The vacuum driven sander as recited in claim 22, wherein the housing is formed as a single rectangular unit to contain the inlet air passages, turbine chamber, stanchion with bearing assembly cavity, and is formed to receive a housing top section fitted thereover wherein are formed air exhaust chambers that are open to said turbine chamber; and the sanding pad is formed as a flat narrow section to receive replaceable sections of sanding material releasably secured to its outer surface and includes, at corners of a top surface of the inner face, as the individual flexing couplers, spiders that each have a top with a screw hole formed therethrough and with equal spaced legs extending from the spider top undersurface that connect, at their opposite ends to their couplings to said top, onto the sanding pad inner face, with the spider tops each to receive a screw turned therethrough and into the housing top section, mounting said sanding pad to said housing top section so as to allow said sanding pad through said spiders to be oscillated.

24. The vacuum driven sander as recited in claim 23, wherein the housing is formed by molding methods from a flat section of stiff material and the port is formed as a continuous passage from the housing outer surface to open into the bearing assembly cavity.

25. The vacuum driven sander as recited in claim 22, wherein the housing top section is a flat section of stiff material formed to fit over the top edges of front, rear and side walls of the housing, has a center hole formed therethrough and includes, formed therein, a pair of spaced turbine ducts that receive the vacuum air exhaust flow from the turbine and direct that flow into the vacuum hose coupling.

26. The vacuum driven sander as recited in claim 25, wherein the vacuum hose coupler includes a collar having external threads that is formed on the center of the housing top section, at the junction of the spaced turbine ducts, is open therethrough and includes radially spaced pivot cavities formed therein around the opening that are identical and are individually to receive individual stub pivots; an exhaust tube that is bent at a center section and includes a pair of stub axles extending outwardly from opposite sides of a ball end of said exhaust tube, and a coupling collar mounted to said exhaust tube end opposite to said ball end for connection to a vacuum tube; and a mounting cap having a center opening formed therethrough to pass said exhaust tube, and is threaded to turn over said collar external threads.

27. The vacuum driven sander as recited in claim 26, wherein the pivot cavities and stub axles are formed to fit together and each has a cylindrical shape; and the exhaust tube is bent at an angle of approximately twenty two and one half (22½) degrees.

28. The vacuum driven sander as recited in claim 26, wherein the coupling collar is a pivot mounting to allow the exhaust tube to pivot around the vacuum tube; and the mounting cap center opening has a significantly greater diameter than that of the exhaust tube, allowing limited pivotal movement of said exhaust tube stub axles in said pivot cavities.

29. The vacuum driven sander as recited in claim 22, wherein the turbine is a split design formed in upper and lower sections, where the lower section has the greater height than the upper section with the upper section for fitting, as a covering over, said lower section, and said upper and lower sections include center plates as contacting surfaces for their assembly, which said contacting plates include aligned turbine axle holes wherethrough a turbine axle is fitted, and a lower end of said turbine axle is secured to a head or top end of the eccentric.

30. The vacuum driven sander as recited in claim 29, wherein turbine blade section of the turbine upper and lower sections are joined along their mating edges; and the turbine axle is a pin having a broad flat top end and is threaded at its lower end for turning into the eccentric top end.

31. The vacuum driven sander as recited in claim 30, further including a cup having a center opening therethrough that is secured across the axle hole formed through the turbine upper section and is to receive the turbine axle broad flat top end; and the eccentric includes a center disk wherefrom the eccentric head or top end extends upwardly and includes an eccentric axle pin mounted off center to said center disk and extending downwardly therefrom to fit into a bearing mounted in a cavity that is formed in the sanding pad inner face.

32. A vacuum driven sander comprising, a housing formed from a rigid material to include internal air inlet passages that are connected to a turbine chamber wherein a stanchion is centered that has a bearing assembly cavity formed therein, and air exhaust passages leading from said turbine chamber to vent through a housing top section; a vacuum hose coupling with a pivotal mounting for connection into said housing top section to receive the vacuum air flow exhausted from said turbine chamber; a turbine and a turbine bearing assembly for mounting in said bearing assembly cavity, with said turbine to turn therein and is a split design formed in upper and lower sections joined along their mating edges, with the lower section having the greater height than the upper section with the upper section for fitting, as a covering over, said lower section, and said upper and lower sections include center plates as contacting surfaces for their assembly, which said contacting plates include aligned turbine axle holes wherethrough a turbine axle is fitted that is formed as a pin having a broad flat top end and is threaded at its lower end for turning into a top end of said eccentric; a sanding pad that includes, on an outer face, sanding material couplers, whereto a section of a sanding material is releasably secured, and has, on an inner face, a plurality of flexing couplers for joining said sanding pad to an undersurface of said housing top section that are secured to said sanding pad inner face, suspending said sanding pad from said housing top section, and said sanding pad includes a bearing for receiving an off center end of said eccentric whereby turning of said turbine and eccentric will impart an orbital motion to said sanding pad; and a port formed through said housing outer surface, passing through said stanchion, and into said bearing assembly cavity for passing ambient air therethrough.

33. The vacuum driven sander as recited in claim 32, wherein the housing is formed as a single rectangular unit to contain the inlet air passages, turbine chamber, stanchion with bearing assembly cavity, and is formed to receive a housing top section fitted thereover wherein are formed air exhaust chambers that are open to said turbine chamber; and the sanding pad is formed as a flat narrow section to receive replaceable sections of sanding material releasably secured to its outer surface and includes, at corners of a top surface of the inner face, as the individual flexing couplers, spiders that each have a top with a screw hole formed therethrough and with equal spaced legs extending from the spider top undersurface that connect, at their opposite ends to their couplings to said top, onto the sanding pad inner face, with the spider tops each to receive a screw turned therethrough and into the housing top section, mounting said sanding pad to said housing top section so as to allow said sanding pad through said spiders to be oscillated.

34. The vacuum driven sander as recited in claim 32, wherein the housing is formed by molding methods from a flat section of stiff material and the port is formed as a continuous passage from the housing outer surface to open into the bearing assembly cavity.

35. The vacuum driven sander as recited in claim 32, wherein the housing top section is a flat section of stiff material formed to fit over the top edges of front, rear and side walls of the housing, has a center hole formed therethrough and includes, formed therein, a pair of spaced turbine ducts that receive the vacuum air exhaust flow from the turbine and direct that flow into the vacuum hose coupling.

36. The vacuum driven sander as recited in claim 35, wherein the vacuum hose coupler includes a collar having external threads that is formed on the center of the housing top section, at the junction of the spaced turbine ducts, is open therethrough and includes radially spaced pivot cavities formed therein around the opening that are identical and are individually to receive individual stub pivots; an exhaust tube that is bent at a center section and includes a pair of stub axles extending outwardly from opposite sides of a ball end of said exhaust tube, and a coupling collar mounted to said exhaust tube end opposite to said ball end for connection to a vacuum tube; and a mounting cap having a center opening formed therethrough to pass said exhaust tube, and is threaded to turn over said collar external threads.

37. The vacuum driven sander as recited in claim 36, wherein the pivot cavities and stub axles are formed to fit together and each has a cylindrical shape; and the exhaust tube is bent at an angle of approximately twenty two and one half (22½) degrees.

38. The vacuum driven sander as recited in claim 36, wherein the coupling collar is a pivot mounting to allow the exhaust tube to pivot around the vacuum tube; and the mounting cap center opening has a significantly greater diameter than that of the exhaust tube, allowing limited pivotal movement of said exhaust tube stub axles in said pivot cavities.

39. The vacuum driven sander as recited in claim 32, wherein the internal air inlet passages are identically formed into opposite end portions of the housing, with each to pull a like volume of air therethrough, providing a balanced air flow that is directed into opposite sides of the turbine.

40. The vacuum driven sander as recited in claim 32, further including a cup having a center opening therethrough that is secured across the axle hole formed through the turbine upper section and is to receive the turbine axle broad flat top end; and the eccentric includes a center disk wherefrom the eccentric head or top end extends upwardly and includes an eccentric axle pin mounted off center to said center disk and extending downwardly therefrom to fit into a bearing mounted in a cavity that is formed in the sanding pad inner face.

* * * * *